US005131436A

United States Patent [19]

Tremer

[11] Patent Number: 5,131,436

[45] Date of Patent: Jul. 21, 1992

[54] MID CLOSING DOBBY

[75] Inventor: Siegmund H. Tremer, Eckersdorf, Fed. Rep. of Germany

[73] Assignee: Staubli & Trumpelt GmbH Maschinenfabrik, Bayreuth, France

[21] Appl. No.: 713,109

[22] Filed: Jun. 11, 1991

[30] Foreign Application Priority Data

Jun. 15, 1990 [FR] France ..... 90 07742

[51] Int. Cl.[5] ..... D03C 1/06

[52] U.S. Cl. ..... 139/69; 139/76

[58] Field of Search ..... 139/69, 71, 68, 76, 139/66 R

[56] References Cited

U.S. PATENT DOCUMENTS

| | | | |
|---|---|---|---|
| 3,612,108 | 10/1971 | Schwarz . | |
| 3,759,298 | 9/1973 | Kaufmann . | |
| 4,326,563 | 4/1982 | Brock et al. | 139/76 |
| 4,412,563 | 11/1983 | Kleiner . | |
| 4,766,935 | 8/1988 | Tanaka et al. | 139/76 |

FOREIGN PATENT DOCUMENTS

| | | |
|---|---|---|
| 2005766 | 7/1971 | France . |
| 2106164 | 4/1972 | France . |
| 2486111 | 1/1982 | France . |

*Primary Examiner*—Andrew M. Falik
*Attorney, Agent, or Firm*—Dowell & Dowell

[57] ABSTRACT

A dobby for a weaving loom including a series of actuation elements which depend on a weaving program incorporated in a reading device and which are coupled to traction levers connected by a drawing system to the heddle frames, wherein, between the traction levers and the drawing systems of at least certain of the actuation elements there is interposed an arm associated with additional actuation elements which impart thereto a periodic oscillating movement which is in synchronism with the operating cycle of the conventional actuating elements. The arms are pivotally carried by the traction levers so as to continue their oscillating movement to one or the other of two work positions of the lever.

10 Claims, 5 Drawing Sheets

MID CLOSING DOBBY

BACKGROUND OF THE INVENTION

1. Field of the Invention

The present invention relates to dobbies for controlling the heddle frames thereby ensuring formation of the shed in weaving looms.

2. History of the Related Art

The majority of textile dobbies, whether they are the rotary type or use pivoting levers, are known to be arranged to operate with an open shed, in that, during each cycle, they actuate the heddle frames so that the frames are moved in a total vertical stroke, without stopping at a median position corresponding to the closure of the shed. However, in certain cases, and more particularly for weaving long-length tubular fabrics, heavy dobbies operating with closed shed must be employed. The heddle frames in such case are controlled to move from the median position of closure in a direction of one or the other of of closure in a direction of one or the other of the extreme positions of opening.

The heavy closed-shed dobbies marketed at the present time generally include the structural elements schematically illustrated in FIG. 1 of the accompanying drawings. For each heddle frame a, the mechanism includes an arm b which is coupled to the frame by a drawing system c associated with a rod system or other connecting device, opposite its pivot point d, each arm b is provided with a double hook e of the swinging type, controlled at its ends by a reading device f containing the weaving program. With the arm b are associated two independent knives g which are actuated to move away from and towards each other simultaneously, on either side of a median position for which they are applied against the free end of arm b.

Under these conditions, it will be readily understood that the reading device f controls the double hook e to thereby connect the arm b with one or the other of the two knives g. The heddle frame a will move vertically either upwardly or downwardly, from the median position shown and for which the shed is closed. The stroke of each frame a may, at the desired moment, thereby be reduced by half with respect to conventional open-shed dobbies.

Nonetheless, it should be observed that the structure of the known heavy dobbies, as recalled hereinabove, present considerable drawbacks in practice. In particular, it will be readily appreciated that the knives g must stop for a period of time when they arrive in the median position so that the device f can cause hook e to swing in one direction or the other. Such stopping obviously results in a substantial reduction in the operational speed of the dobby and of the loom, and at the same time creates detrimental effects of acceleration and deceleration.

U.S. Pat. No. 3,612,108 to STAUBLI in particular proposes dobbies capable of operating with open shed, closed shed or mixed shed, in which the traction levers controlled by the actuation elements depending on the weaving program, are connected to the drawing system of each heddle frame via a pivoting arm. The arm is associated with additional actuation elements adapted to impart to the arm a periodic swinging movement in synchronism with the control cycle of the actuation elements.

In that Patent, the intermediate pivoting arm is pivotally mounted on a fixed shaft while the additional actuation elements include a cam mechanism. Against the periphery of this cam is elastically applied a follower roller carried by the pivoting arm, which is connected to the corresponding traction lever by a slide system.

Operation obtained with such a structure is not entirely satisfactory and the user encounters considerable drawbacks in practice. In particular, control of the swinging or pivoting arm is not positively ensured as the cam mechanism can give only a lifting movement to the corresponding heddle frame.

In other types of dobbies capable of operating with open shed and closed shed, the actuation elements are connected in twos so that, in each pair, one of the elements ensures normal control of the traction lever of the pair while the other is adapted to give the pivoting arm coupled to the lever an additional cyclic movement corresponding to the closed shed. Reference be made on this point to U.S. Pat. Nos. 3,759,298 and 4,412,563 to STAUBLI.

Such a system indeed allows a positive control to be obtained, but the necessity of coupling the actuation elements in twos obviously reduces by half the number of heddle frames capable of being controlled by the dobby, for the same dimensions thereof.

It is an object of the present invention to overcome all the different types of drawbacks mentioned above.

SUMMARY OF THE INVENTION

This invention relates to a dobby for weaving loom, of the type in which at least certain of the traction levers controlled by the actuation elements depending on the weaving program incorporated in the reading device, are connected to the drawing system of the corresponding heddle frame via a pivoting arm which is associated with additional actuation elements adapted to impart thereto a periodic swinging movement in synchronism with the control cycle of the actuation elements. Further, the pivoting arm is freely supported by three moveable points of coupling which connect each arm respectively to the traction lever and to the corresponding drawing system and to the actuation elements while the elements are arranged to ensure permanent positive control of the arm in an attempt systematically to return the corresponding heddle frame in the direction of closure of the shed, whatever the position of such frame.

BRIEF DESCRIPTION OF THE DRAWINGS

The invention will be more readily understood on reading the following description with reference to the accompanying drawings, in which.

DETAILED DESCRIPTION OF THE DRAWINGS

Figure 2:
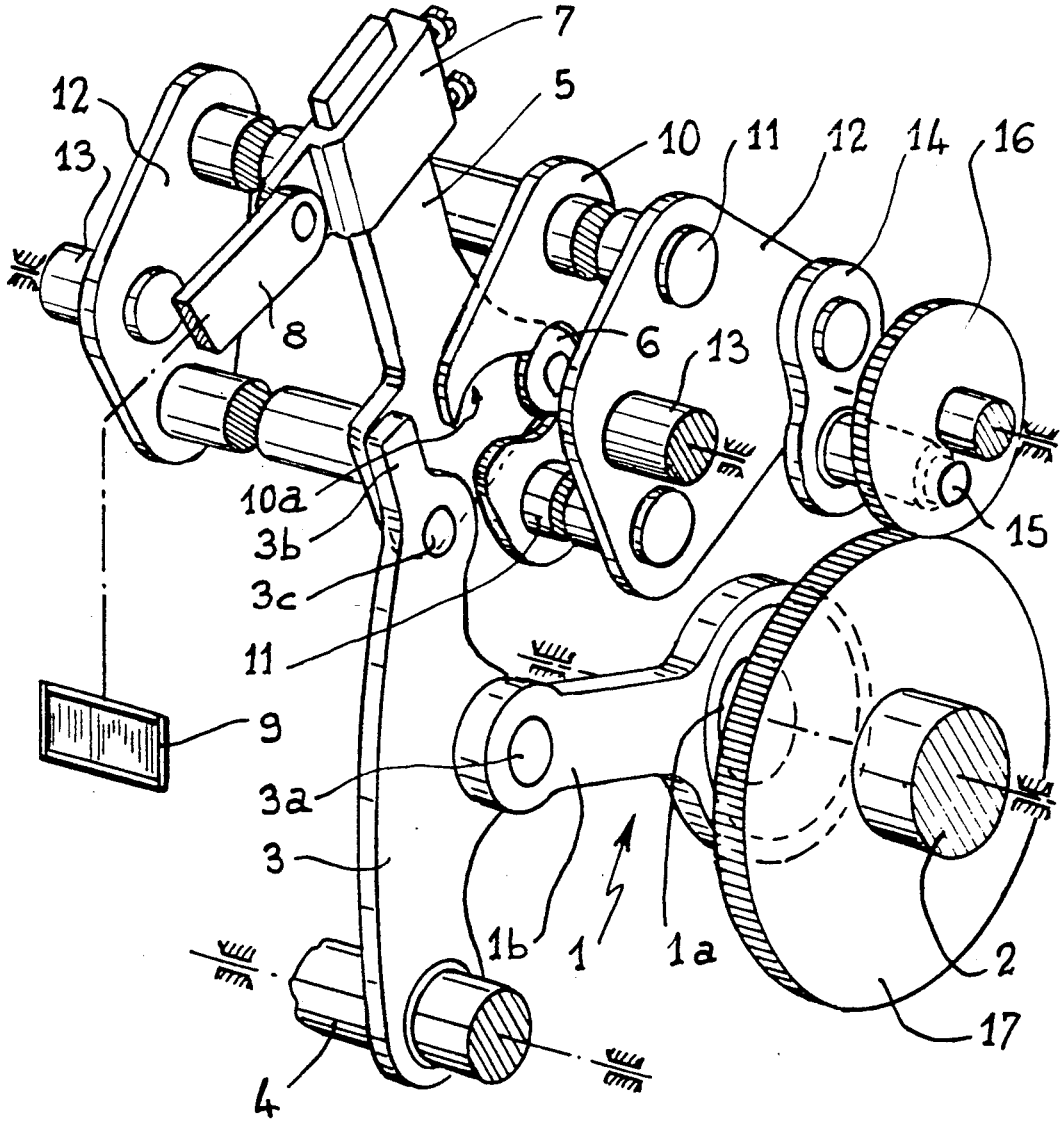
FIG. 2 is a view in perspective showing the arrangement of a dobby according to the invention.

Referring now to the drawings, the dobby according to the invention comprises an assembly of actuation elements 1 (FIG. 2) similar to those of a conventional dobby of rotary type. The arrangement of these elements 1 has not been shown in detail and it will merely be recalled that each of them is constituted by an eccentric 1*a* mounted on a shaft 2 common to all of the elements 1. The connection of this eccentric 1*a* with the shaft 2 is ensured by a coupling member (not shown) depending on the programmed reading device of the dobby. The eccentric 1*a* is housed in an eccentric opening in a connecting rod 1*b* of which the free end is coupled at 3*a* with a traction lever 3.

All the traction levers 3 of the dobby pivot on a common pin 4 oriented parallel to the shaft 2 and it will be understood that, when the eccentric 1*a* is connected with the shaft, rotation of the shaft 2 through 180° imparts to the element 1 and to its traction lever 3 an oscillating movement. In known rotary dobbies, it is on the terminal end 3*b* of these levers 3 that the drawing system associated with the heddle frame shown is fixed.

On the contrary, in the case of the dobby according to the invention, on each traction lever 3 there freely articulates at 3*c* a double arm 5 with set-square profile which is equipped with a roller 6 at one of its ends, while the opposite end forms a securing point for a collar 7 provided at the end of the drawing system 8 of one of the heddle frames 9 of the weaving loom. The roller 6 is engaged with reduced clearance in a slot 10*a* made inside the profile of a moveable part 10 forming a cam, so that the arm 5 is, in the end, freely coupled or articulated to the lever 3, the drawing system 8 and to the cam 10.

All the parts or cams 10 are engaged and axially fixed on two rods 11 oriented parallel to shaft 2 and carried by side elements 12. Each of these side elements is secured to a lateral pivot 13 rotatably supported by the frame (not shown) of the dobby, with the result that the assembly of elements 11–12 constitute a sort of chassis adapted to oscillate along the axis of pivots 13. It should be observed that this axis 13—13 passes through the center of symmetry of the slot 10*a* in each cam 10, which slot defines the path of the roller 6 that it controls.

One of the side elements 12 is joined by a small rod 14 to a shaft end 15 mounted to a toothed wheel 16 which meshes with a wheel 17 of larger diameter fitted on shaft 2. It will be understood that the assembly 14–15 forms an eccentric crank pin which, during jerky rotation of the shaft 2, imparts to the elements 11–12 and to the cams 10 mounted thereon an oscillating movement centered on the pivot axis defined by pivots 13. It will be noted that the diameter of the toothed wheel 17 is equal to twice that of the toothed wheel 16, so that elements 11–12 are animated by two oscillations upon each revolution of the shaft 2, the shaft 2 being, in conventional manner in rotary dobbies, rotated by an intermittent rotary displacement with stop every 180°.

Figure 3:
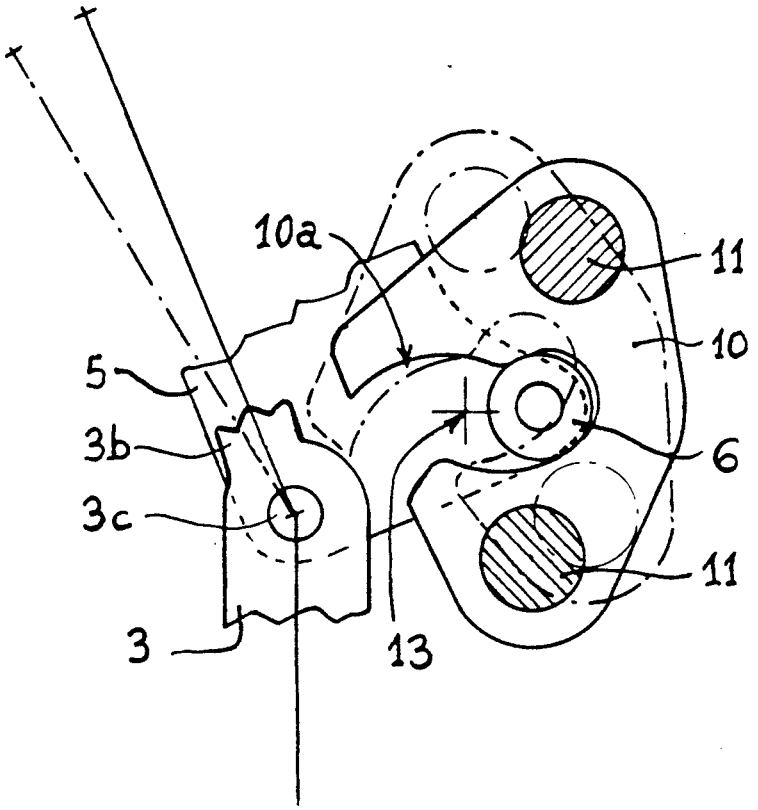
FIGS. 3 and 4 are transverse sections of the swinging chassis of the dobby according to FIG. 2, the parts being shown in two positions of operation of the corresponding actuation element.
Figure 4:
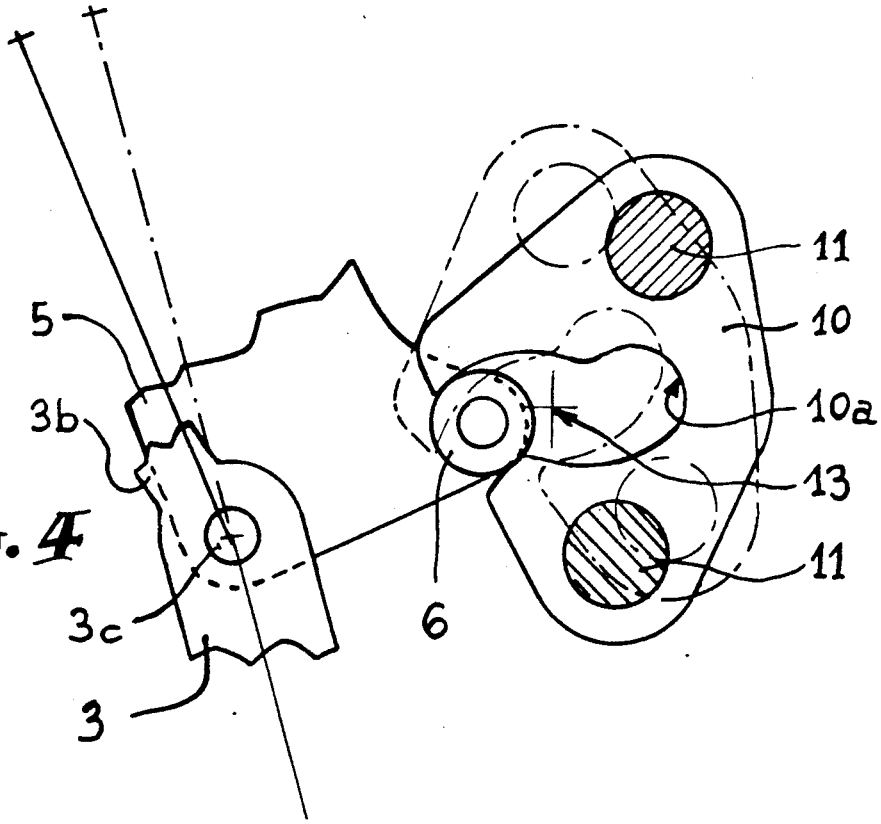

In the manner illustrated in FIG. 3, the periodic oscillation of elements 11–12 are, of course, further to the engagement of the roller 6 in the slot 10*a* in each cam 10, transmitted to arm 5 and to the drawing system 8 associated with the cam, which results in effecting displacement of frame 9. It is essential here to observe that the particular profile of the slot 10*a* enables the arm 5 to oscillate to one or the other of the two operational positions of the traction lever 3 shown. The roller 6 slides freely in the slot 10*a* when the lever 3 changes orientation under the effect of its actuation element 1, as a comparative examination of FIGS. 3 and 4 will show.

Figure 6:
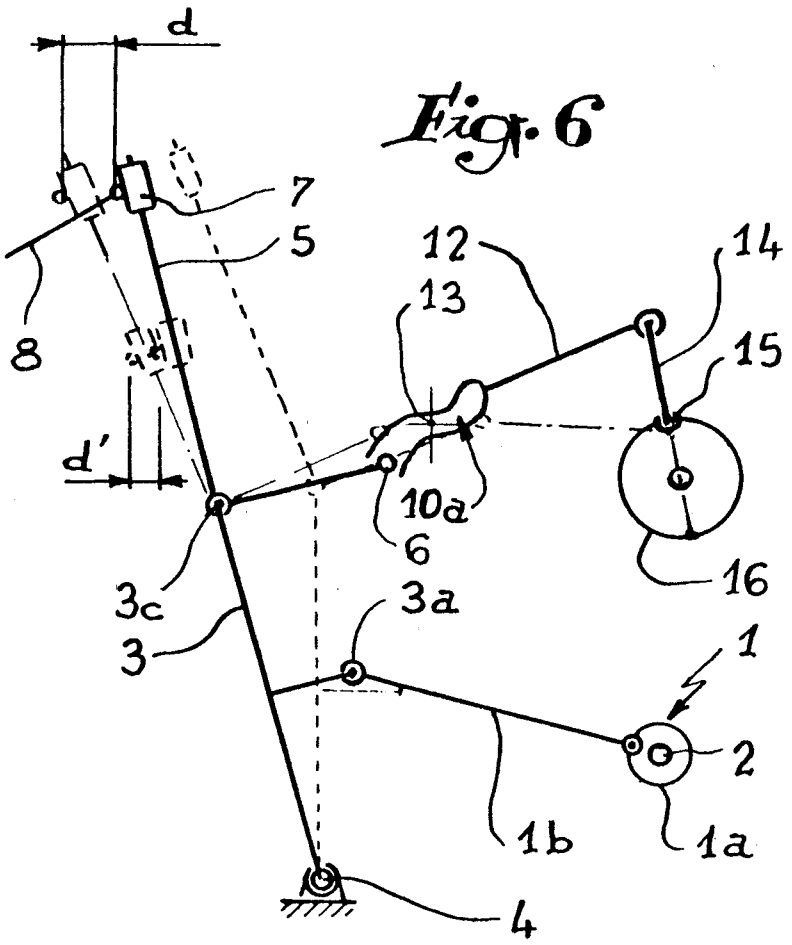
FIGS. 5 and 6 schematically illustrate the general operation of the dobby.
Figure 5:
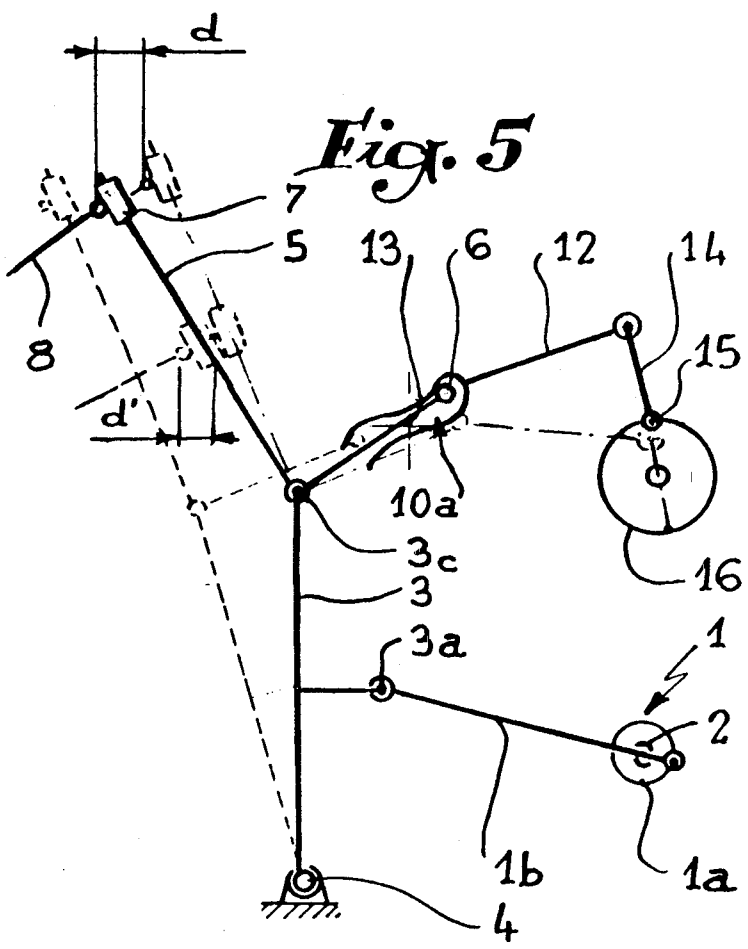

Such systematic functioning is likewise seen from the diagrams of FIGS. 5 and 6, in which the length of the two parts of the double arm 5 has been elongated in order to illustrate the invention more clearly. It may be seen in particular that the amplitude d of the oscillating displacement of the collar or fastener 7 remains identical whatever the orientation that the connecting rod 1*b* of the actuation element gives to the traction lever 3. This displacement is simply disposed in one or the other of two symmetrical zones depending on the weaving program.

Figure 7:
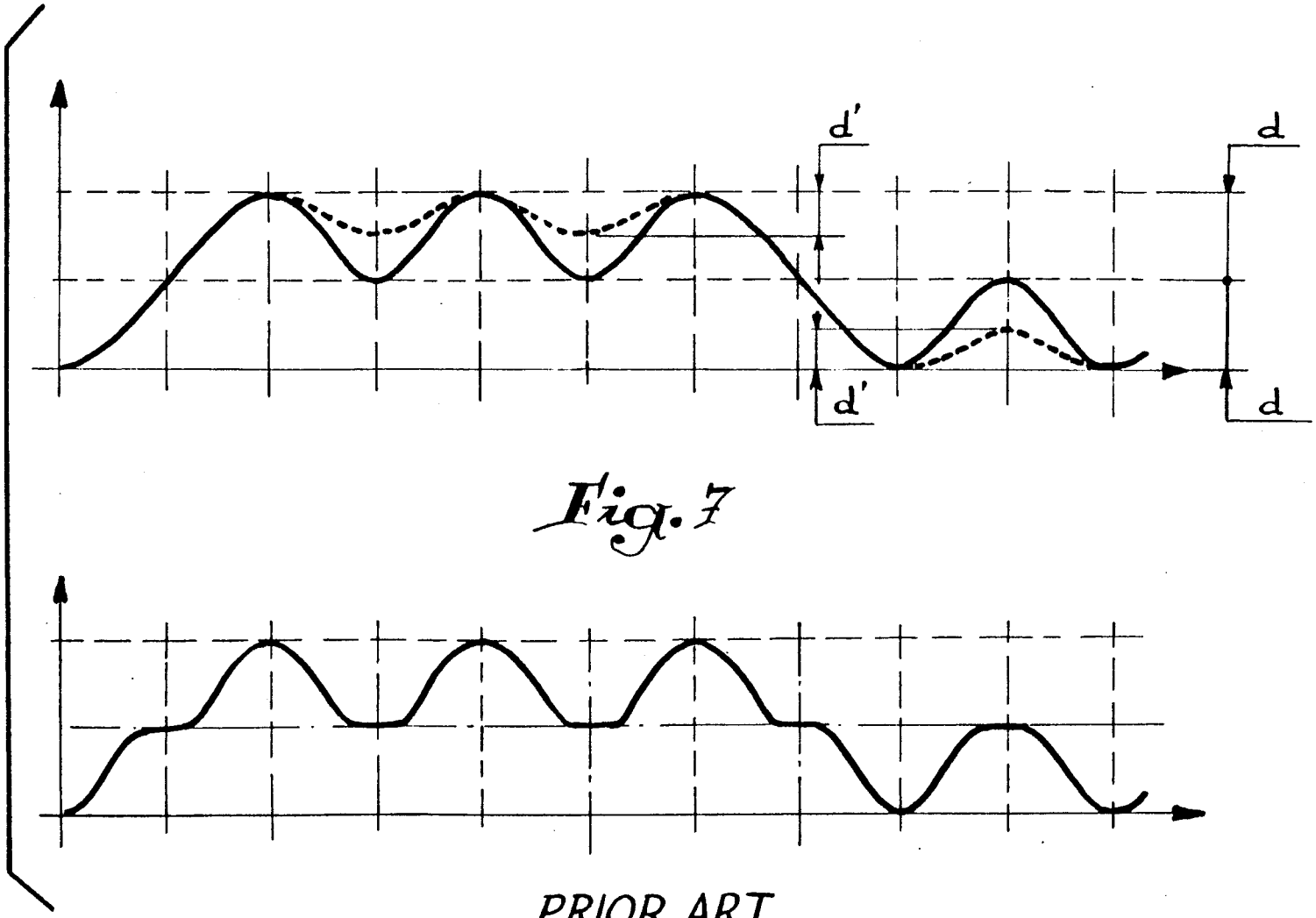
Fig. 7 PRIOR ART
FIG. 7 illustrates two diagrams which show the movement imparted to one of the heddle frames, by a dobby according to the invention in the upper part, by a conventional dobby of the type according to FIG. 1 in the lower part.

The closed shed stroke indicated in the diagram in the upper part of FIG. 7 is therefore obtained for heddle frame 9. As long as the actuation element 1 which depends on the weaving program has not modified the orientation of the traction lever 3, frame 9 moves alternately from the median position corresponding to the closure of the shed, upwardly or downwardly for the opening and the passage of the pick, and vice versa. It will be observed in FIGS. 5 or 6 that the amplitude of the vertical displacement of the frame 9 is capable of being modified (value d' according to the broken line) by adjusting the longitudinal position of the collar 7 along the upper part of the double arm 5, it being further noted that such adjustment may be differentiated depending on the arms of the dobby.

This independence of the adjustments is also augmented by the ease in obtaining a mixed shed, the drawing system 8 being able, depending on the frames 9, to be attached either on arm 5 or on the terminal end 3*b* of the lever 3.

Figure 1:
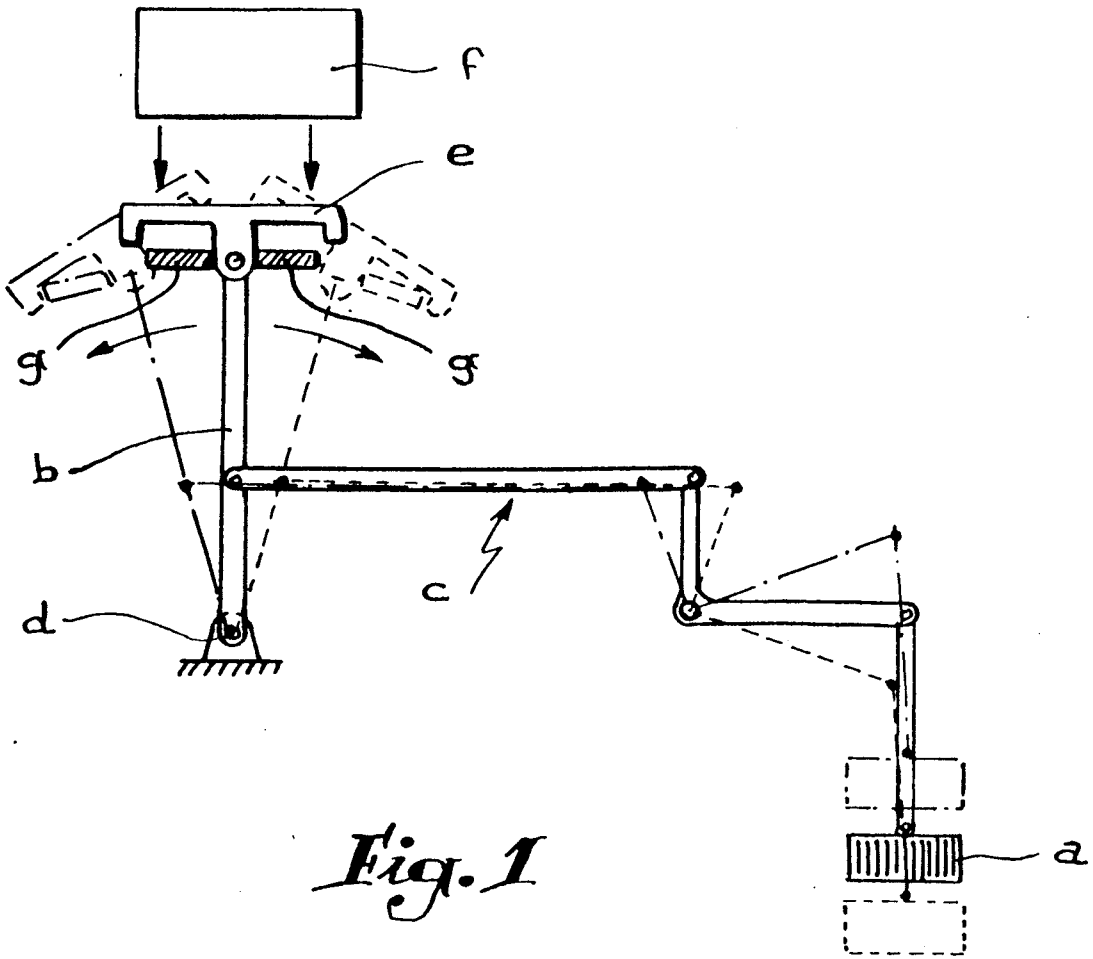
Fig. 1 PRIOR ART
FIG. 1, as indicated hereinbefore, is a diagram illustrating the arrangement of certain conventional, heavy, closed-shed dobbies.

It is interesting to note that, contrary to the conventional system schematically shown in FIG. 1, the dobby according to the invention works without clearance. The displacement of the frames 9 in a closed shed operation is effected harmoniously, without any stop in the median position of closure (a comparison with the lower diagram of FIG. 7 clearly shows the situation), which in fact eliminates harmful stresses and the phenomena of acceleration and of braking mentioned hereinbefore. The dobby is thus capable of working at substantially higher operational speeds than the conventional heavy dobbies.

The invention may be carried out with actuation elements both according to the rotary system evoked and described hereinabove and according to the Hattersley system (swinging levers with hooks). From another standpoint, for the oscillating control of the intermediate arm 5, cam mechanisms may be imagined which are different from the one (roller 6/slot 10*a*) which has been illustrated in the drawings, these cam mechanisms themselves being replaceable by any other appropriate actuation elements.

What is claimed is:

1. In a dobby for a weaving loom of the type which includes at least one traction lever controlled by actuation elements depending on a weaving program incorporated in a reading device and wherein the traction lever is connected to a drawing system of a heddle frame via a pivoting arm and wherein the heddle frame is moveable to either side of a median position corresponding to the closure of a shed of the loom, the improvement comprising, additional actuation means for imparting to the pivoting arm a periodic swinging movement in synchronism with the actuation elements, the pivoting arm being freely supported by three movable points of coupling which connect the pivoting arm respectively to the traction lever, the drawing system and to said additional actuation means, said additional actuation means including means for ensuring permanent control of the pivoting arm to return the heddle frame in the direction of the median position regardless of the position of the heddle frame.

2. The dobby of claim 1 in which said pivoting arm includes first and second ends, said first end being connected to the drawing system by way of one of said three movable points of coupling, said second end of said pivoting arm having a roller mounted thereto, said additional actuation means including a cam means, said cam means being carried by a pivoting assembly of elements so as to be movable in an oscillating manner, a slot in said cam means, and said roller being guided within said slot of said cam means.

3. The dobby of claim 2 wherein the assembly of elements includes two side members having two rods extending therebetween in spaced parallel relationship with respect to one another, said cam means being mounted to said two rods.

4. The dobby of claim 2 including a connecting rod for connecting the traction lever to a primary rotational drive shaft, a crank pin means connected to said assembly of elements for oscillating said assembly of elements, and means for rotating said crank pin at a rate which is double the rotational rate of the primary drive shaft.

5. The dobby of claim 4 wherein said crank pin means is carried by a first toothed wheel, a second toothed wheel being mounted to the primary drive shaft, said first and second toothed wheels being meshed with one another.

6. The dobby of claim 2 in which said assembly of elements includes an axis about which it is oscillated, said axis being substantially aligned with said slot in said cam means.

7. The dobby of claim 6 wherein the assembly of elements includes two side members having two rods extending therebetween in spaced parallel relationship with respect to one another, said cam means being mounted to said two rods.

8. The dobby of claim 7 including a connecting rod for connecting the traction lever to a primary rotational drive shaft, a crank pin means connected to said assembly of elements for oscillating said assembly of elements, and means for rotating said crank pin at a rate which is double the rotational rate of the primary drive shaft.

9. The dobby of claim 8 wherein said crank pin means is carried by a first toothed wheel, a second toothed wheel being mounted to the primary drive shaft, said first and second toothed wheels being meshed with one another.

10. The dobby of claim 1 in which said traction lever includes a terminal end portion for selective coupling to a drawing system when disconnected from said pivoting arm.

* * * * *